US006374424B1

(12) United States Patent
Tredup

(10) Patent No.: US 6,374,424 B1
(45) Date of Patent: Apr. 23, 2002

(54) PROTECTIVE FACE MASK

(76) Inventor: Thomas R. Tredup, 388 S. E. 3rd. Ct., Pompano Beach, FL (US) 33060

( * ) Notice: Subject to any disclaimer, the term of this patent is extended or adjusted under 35 U.S.C. 154(b) by 0 days.

(21) Appl. No.: 09/563,020

(22) Filed: May 2, 2000

(51) Int. Cl.[7] ..... A61F 9/02; A61F 9/04; A41D 3/18

(52) U.S. Cl. ..... 2/427; 2/432; 2/448; 2/9

(58) Field of Search ..... 2/9, 12, 427, 432, 2/448, 449, 450, 436, 206, 8, 431; 351/158; 128/857; 446/27

(56) References Cited

U.S. PATENT DOCUMENTS

| | | | | | |
|---|---|---|---|---|---|
| 1,199,529 | A | * | 9/1916 | Collman | 128/857 X |
| 2,568,316 | A | | 9/1951 | Brown | 2/428 |
| 2,965,902 | A | * | 12/1960 | Louch | 2/9 |
| 3,015,105 | A | * | 1/1962 | Rogowski | 2/9 |
| 3,423,763 | A | | 1/1969 | Schwartz | 2/9 |
| 3,789,428 | A | | 2/1974 | Martin | 2/9 |
| 4,411,023 | A | | 10/1983 | Pinson | 2/7 |
| 4,637,383 | A | | 1/1987 | Lopez | 128/201.25 |
| 4,937,880 | A | | 7/1990 | Beard | 2/9 |
| 5,056,163 | A | | 10/1991 | Chou | 2/431 |
| 5,146,636 | A | | 9/1992 | DeLaPena | 2/8 |
| 5,220,689 | A | | 6/1993 | Miller | 2/427 |
| 5,313,666 | A | | 5/1994 | Bax et al. | 2/9 |
| 5,471,679 | A | * | 12/1995 | Paoluccio | 2/9 |
| 5,619,749 | A | * | 4/1997 | Banuchi | 2/9 |
| 5,623,733 | A | | 4/1997 | Kurimoto et al. | 2/9 |
| 5,625,902 | A | | 5/1997 | Drews et al. | 2/205 |
| 5,825,849 | A | | 10/1998 | Maletich | 2/427 |

* cited by examiner

*Primary Examiner*—Peter Nerbun
(74) *Attorney, Agent, or Firm*—Oltman, Flynn & Kubler

(57) ABSTRACT

A protective face mask with a concavo-convex shield of methyl methacrylate that covers the wearer's entire face. A nose piece at the concave face of the shield presents laterally spaced fingers to engage the wearer's nose on opposite sides for spacing the shield from the face. Temple sidepieces hinged to the shield on opposite sides are engageable over the wearer's ears to hold the nose piece against the wearer's nose, thus securely positioning the mask on the wearer's head.

8 Claims, 3 Drawing Sheets

PROTECTIVE FACE MASK

BACKGROUND OF THE INVENTION

1. Field of the Invention

This invention relates to a protective face mask specifically intended to protect a person's face from harmful effects of the sun, particularly ultraviolet rays, and having other protective uses, as well.

2. Prior Art

Various masks and hoods have been proposed heretofore for a variety of protective purposes, as shown in the following U.S. Pat. Nos.: Miller 5,220, 689 and Maletich 5,815,849—for shielding a person's face from solar radiation; Martin 3,789,428—for protecting the head from wind chill; Brown 2,568,316—for swimming; Beard 4,937,880—for shielding the face from liquid splashes and solid particles in the air; Pinson 4,411,023 and Lopez 4,637,383—for protecting the head from fire and toxic gases; Drews et al 5,625,902—to support an oxygen breathing apparatus and shield the head from gases; and Kurimoto et al 5,623,733—to retain skin moisture for facial beauty.

SUMMARY OF THE INVENTION

The present invention is a protective face mask with a shield providing full face coverage and a novel arrangement for securely positioning the mask on a person's head with comfortable separation of the shield from the person's face. Preferably, the shield has a concavo-convex shape and is made of a transparent hard plastic that protects the face from the sun's ultraviolet radiation. The entire mask is a UV lens and/or other plastic for fashion purposes or for protection against such things as flying debris. The mask has a nose bridge projecting from the concave face of the shield and positioned to engage the wearer's nose to space the shield from the face for free flow of air for breathing and reduction of heat. Temple sidepieces hinged to the shield at opposite sides are engageable over the wearer's ears. In conjunction with each other, the nose bridge and the temple sidepieces position the face mask securely on the person's head with the desired clearance of the shield from the face.

A principal object of the present invention is to provide a novel and improved face mask for protection from harmful effects of the sun.

Further objects and advantages of this invention will be apparent from the following detailed description of a presently preferred embodiment thereof, shown in the accompanying drawings.

BRIEF DESCRIPTION OF THE DRAWINGS

FIG. 6 is a bottom plan view of the mask with its temple sidepieces folded in;

DETAILED DESCRIPTION OF THE PRESENT INVENTION

Before explaining the present invention in detail it is to be understood that the invention is not limited in its application to the particular arrangement shown and described since the invention is capable of other embodiments. Also, the terminology used herein is for the purpose of description and not of limitation.

Figure 2:
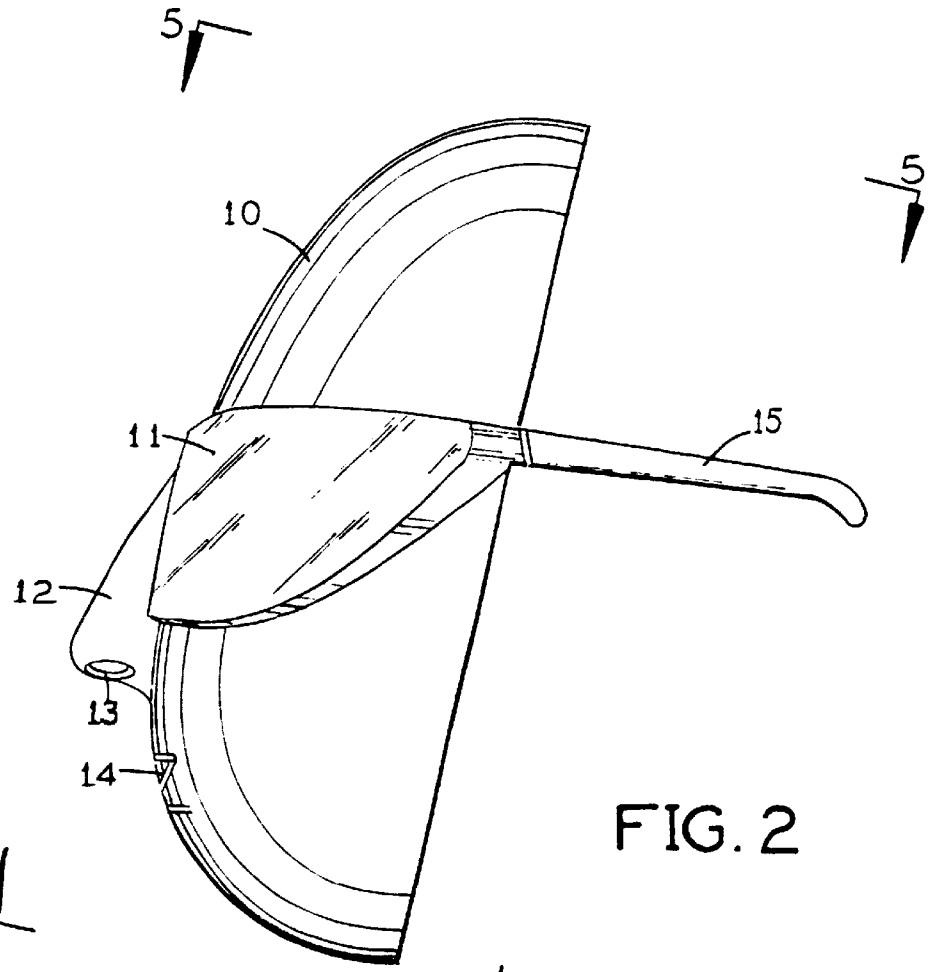
FIG. 2 is a side view of the mask taken from the right side of FIG. 1.
Figure 4:
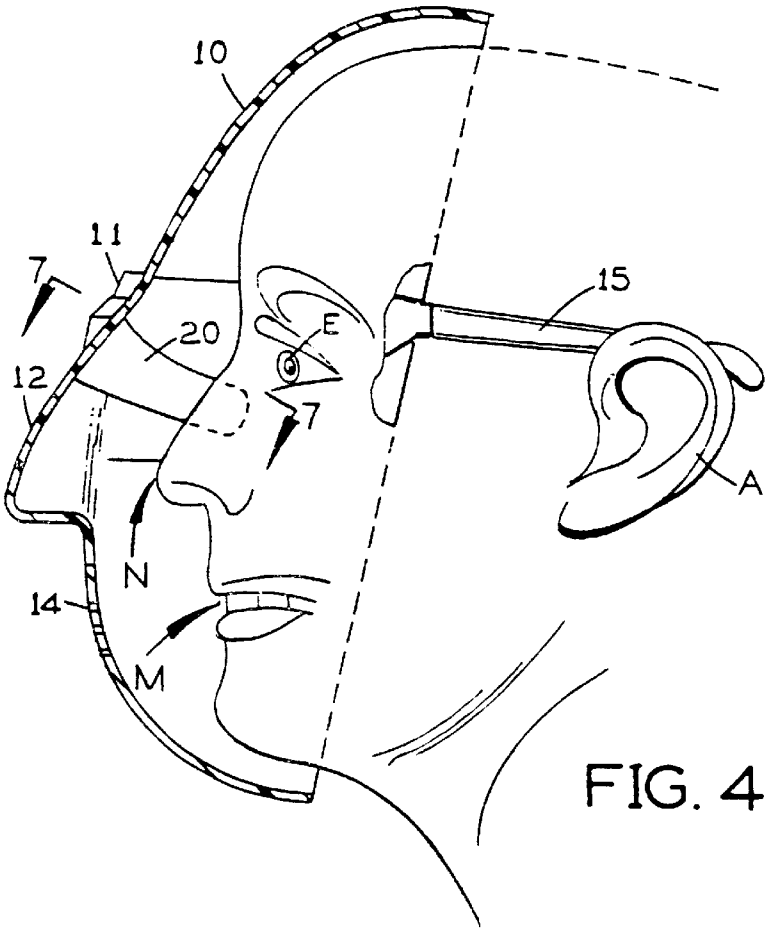
FIG. 4 is a vertical section taken along the line 4—4 in FIG. 1 and showing the mask in place on a person's head.

Referring first to FIGS. 2 and 4, the face mask of the present invention has a molded, concavo-convex shield 10 that is shaped and dimensioned to completely cover the face of a person wearing it, as best seen in FIG. 4. The entire shield preferably is composed of methyl methacrylate, an acrylic resin sold under well known trademarks, such as Lucite and Plexiglass. This material is hard, transparent, resistant to the deleterious effects of light and aging, and has both high optical clarity and a high refractive index. Preferably, the shield is tinted, for both functional and aesthetic reasons, and it minimizes the wearer's face exposure to harmful ultraviolet radiation from the sun.

Figure 1:
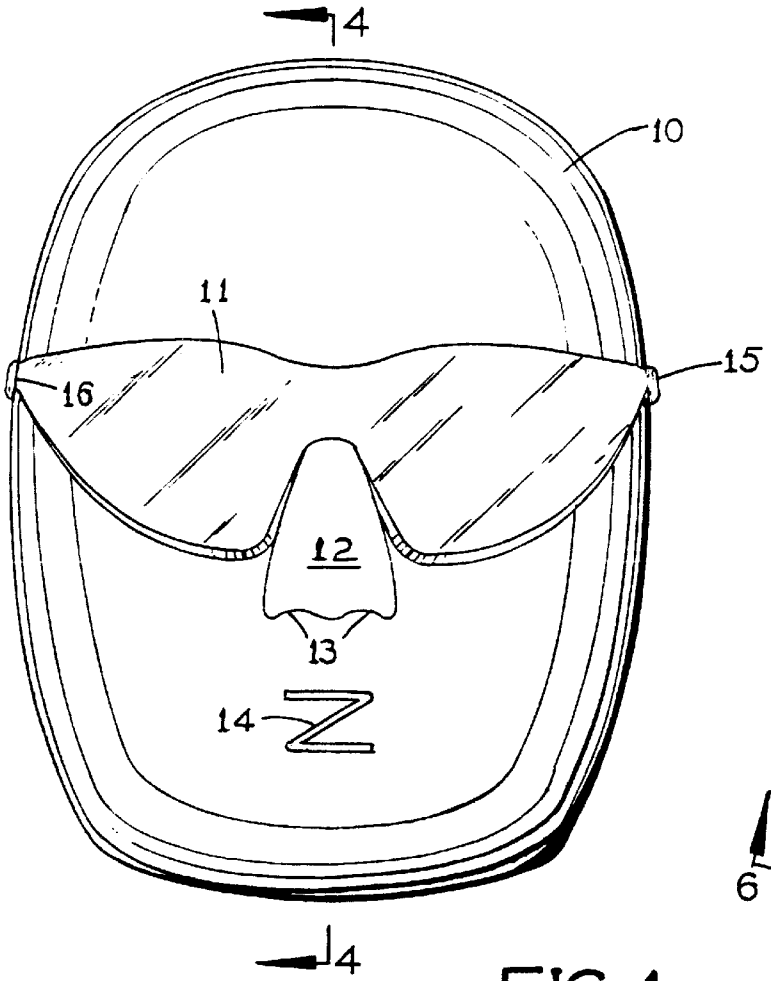
FIG. 1 is a front elevation of the present face mask showing its convex outer face.
Figure 3:
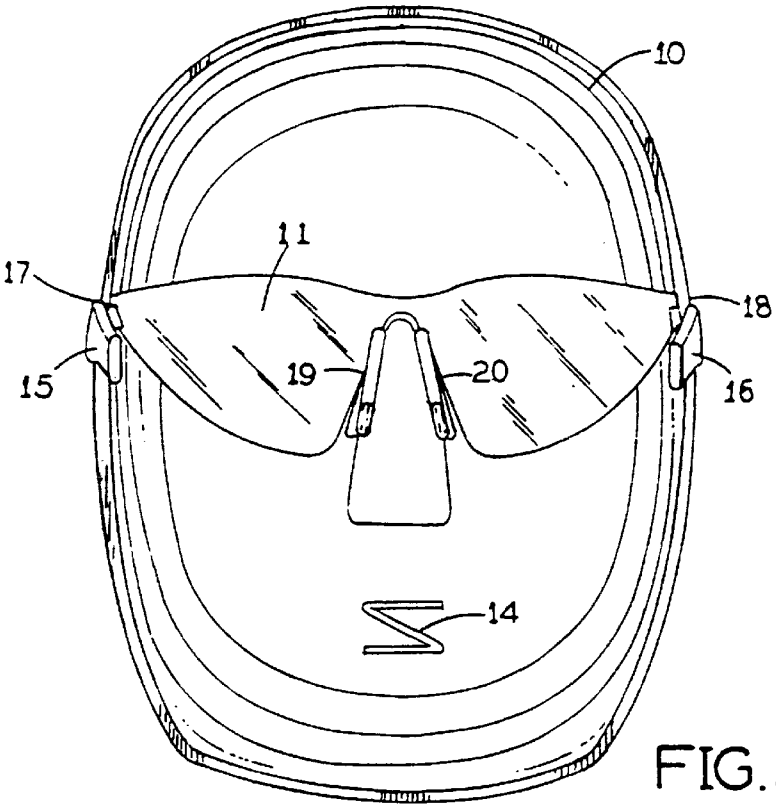
FIG. 3 is a rear view of this mask showing its concave inner face.

Shield 10 has a transparent window 11 (FIG. 1) positioned at the level of the wearer's eyes E and nose N. The window has a forwardly protruding, concavo-convex segment 12 that simulates a human's nose. This nose segment of the shield is apertured at the bottom, presenting a pair of openings 13 that simulate a person's nostrils and are positioned at substantially the level of the wearer's nostrils, as shown in FIG. 4, to facilitate breathing and avoid fogging up the inner side of shield 10.

The shield is also apertured at 14, at substantially the level of the wearer's mouth M, for the same reasons. If desired, the shield may be shaped to simulate a human person's lips at this location.

Figure 6:
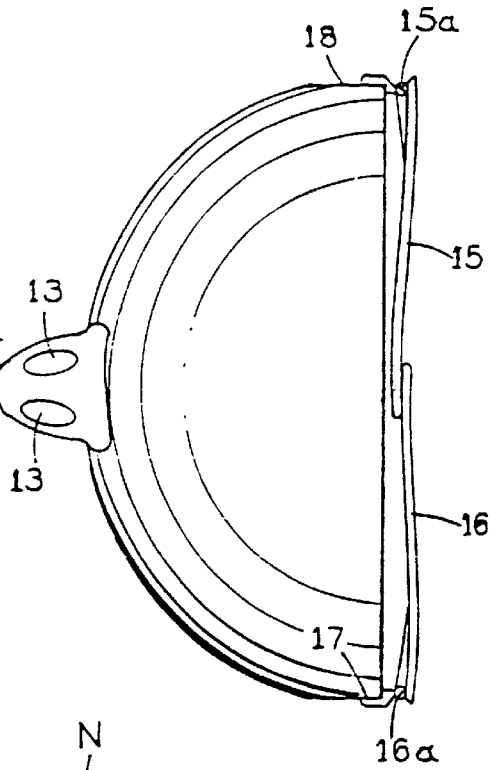
Figure 8:
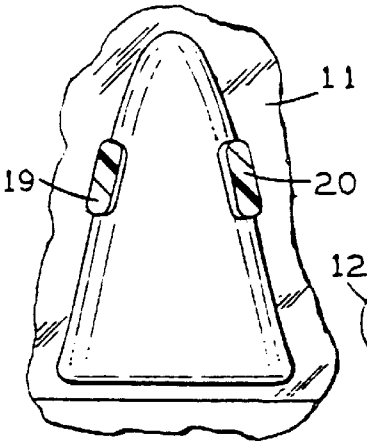
FIG. 8 is a fragmentary section taken along the line 8—8 in FIG. 7.
Figure 5:
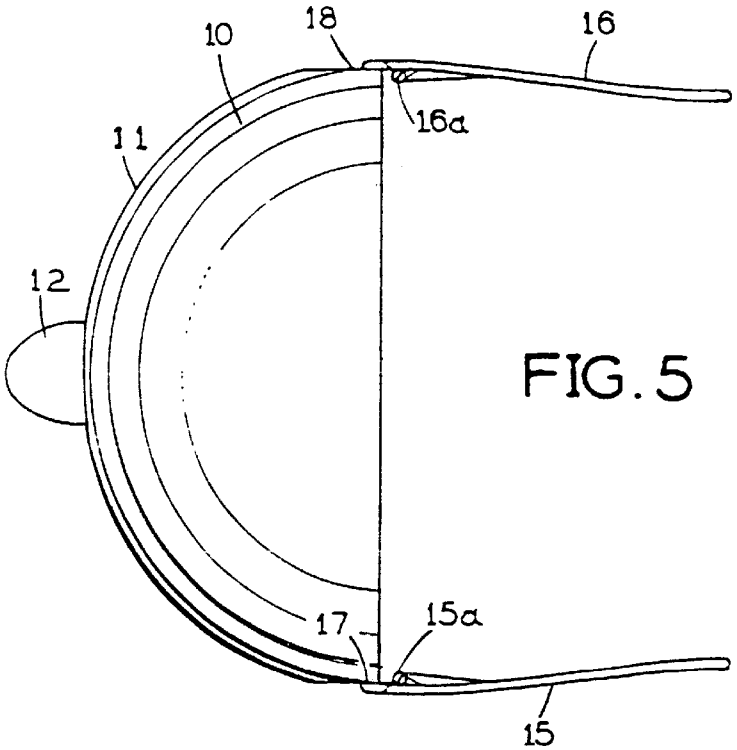
FIG. 5 is a top plan view of the mask with its ear-mounted temple sidepieces folded out.

Temple sidepieces 15 and 16 are hinged at 15*a* and 16*a*, respectively (FIGS. 5 and 6), to the shield 10 at opposite side edges 17 and 18 thereof. When folded out (FIGS. 1–5), these sidepieces are engageable over the wearer's ears A in the usual manner of eyeglasses, as best seen in FIG. 4, to mount the face mask on a person's head.

Figure 7:
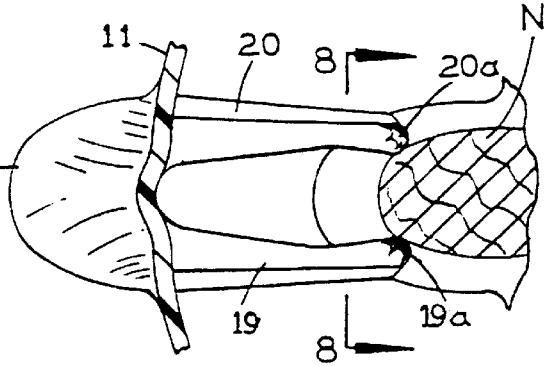
FIG. 7 is a cross-section taken along the line 7—7 in FIG. 4 just above the nose piece on the mask, showing how the nose piece engages the wearer's nose on opposite sides.

In accordance with an important feature of the present invention, a comfortable spacing of the concave inner side of the shield 10 from the wearer's face is achieved by providing spacer means in the from of a bifurcated nose piece having laterally spaced arms or prongs 19 and 20 joined integrally to the window 11 at its concave face and projecting rearward from it to engage the opposite sides of the wearer's nose N, as shown in FIGS. 4 and 7. These arms or prongs terminate in rounded tips 19*a* and 20*a* that contact the wearer's nose without causing discomfort. In conjunction with the ear-mounted temple sidepieces 15 and 16, the nose piece 19, 20 maintains the shield 10 at a comfortable distance from the person's face, preferably about 1.5 inches. A person who wears eyeglassses can keep them on while wearing the present face mask.

It will be evident that the face mask of the present invention can be readily positioned securely in a stable manner on a person's head and readily removed from it when desired. It provides complete protection for the person's face from harmful effects of the sun's rays. Also, it can be worn for the purpose of protecting the wearer's eyes and face from flying particles occasioned by metalworking, plastic working or woodworking operations, either in a factory or at home, for example. Also, the mask of the present invention can be worn for strictly decorative purposes, such as on Halloween or at a costume party, because of its comfortable design.

I claim:

1. A face mask comprising a shield of hard plastic that blocks the sun's rays shaped and dimensioned to extend completely over a person's face, said shield having a convex outer face and a concave inner face, and positioning means for positioning the mask on a person's head, said positioning means including a nose piece projecting from the inner face of said shield at the level of the person's nose to engage the person's nose and position the shield away from the person's face, said positioning means also comprising a pair of temple sidepieces extending from said shield on opposite peripheral sides thereof to engage the person's ears for holding the shield in place on the person's head with said nose piece against the person's nose.

2. A face mask according to claim 1, wherein said shield has a transparent window at the level of the person's eyes and nose, and said shield is apertured at substantially the level of the person's nostrils and at substantially the level of the person's mouth.

3. A face mask comprising an integral shield shaped and dimensioned to extend completely across the height and width of a person's face and having outer and inner faces, and positioning means for positioning the mask on a person's head, said positioning means including spacer means at the inner face of said shield at the level of the person's nose to position the shield away from the person's face, said spacer means comprising two arm members extending rearwardly from said shield inner face and having arm member lengths to space said shield from a person's face a certain distance and said arm members being laterally spaced apart from each other a distance to receive between them a portion of a person's nose.

4. A face mask according to claim 3, wherein said arm members are each elongate, each said arm member having an arm member length greater than its arm member width.

5. A face mask according to claim 3, wherein said positioning means also comprises a pair of temple sidepieces extending from said shield on opposite peripheral sides thereof to engage the person's ears for holding the shield in place on the person's head with said spacer means against the person's nose.

6. A face mask according to claim 5, wherein said shield is concavo-convex and said spacer means is at the concave face thereof, and said shield is entirely transparent and incorporates ultraviolet protection, and said shield member being apertured at substantially the level of the person's mouth.

7. A face mask according to claim 3, wherein said shield is concavo-convex and said spacer means is on the concave face thereof, and said shield is entirely transparent and incorporates ultraviolet protection.

8. A face mask comprising an integral shield shaped and dimensioned to completely cover a person's face from top to bottom and from side to side and having outer and inner faces, and positioning means for positioning the mask on a person's head, said positioning means including spacer means at the inner face of said shield at the level of the person's nose to position the shield away from the person's face, said spacer means comprising two arm members integral with said shield and extending rearwardly from said shield inner face and having arm member lengths to space said shield from a person's face a certain distance and said arm members being laterally spaced apart from each other a distance to receive between them a portion of a person's nose;

wherein said positioning means also comprises a pair of temple sidepieces integral with and extending from said shield on opposite peripheral sides thereof to engage the person's ears for holding the shield in place on the person's head with said spacer means against the person's nose.

* * * * *

UNITED STATES PATENT AND TRADEMARK OFFICE

CERTIFICATE OF CORRECTION

PATENT NO. : 6,374,424 B1
DATED : April 23, 2002
INVENTOR(S) : Thomas R. Tredup

It is certified that error appears in the above-identified patent and that said Letters Patent is hereby corrected as shown below:

Title page,
Item [76], Inventor, replace name and address as shown below:
-- Thomas R. Tredup
4791 S. Citation Drive #106
Delray Beach, FL 33445 --

Signed and Sealed this

Twenty-sixth Day of August, 2003

JAMES E. ROGAN
*Director of the United States Patent and Trademark Office*